United States Patent [19]

Banning

[11] 4,431,255

[45] Feb. 14, 1984

[54] COAXIAL CONNECTOR

[75] Inventor: Harmon W. Banning, Derwood, Md.

[73] Assignee: Weinschel Engineering Co., Inc., Gaithersburg, Md.

[21] Appl. No.: 323,608

[22] Filed: Nov. 20, 1981

Related U.S. Application Data

[63] Continuation of Ser. No. 95,433, Nov. 19, 1979, abandoned.

[51] Int. Cl.[3] ..... H01R 17/12

[52] U.S. Cl. ..... 339/177 E

[58] Field of Search ..... 339/177 R, 177 E, 218 R, 339/218 M; 333/260; 174/75 C, 88 C

[56] References Cited

U.S. PATENT DOCUMENTS

| | | | |
|---|---|---|---|
| 2,152,504 | 3/1939 | Scott et al. | 339/177 R |
| 2,949,642 | 8/1960 | Lieberman | 339/218 R |
| 3,292,136 | 12/1966 | Somerset | 339/177 E |
| 3,340,495 | 9/1967 | Weinschel | 339/177 R |
| 3,530,425 | 9/1970 | Vachhani | 339/177 R |
| 3,609,637 | 9/1971 | Cole | 339/177 R |
| 3,678,447 | 7/1972 | Ziegler, Jr. et al. | 339/177 E |
| 3,936,132 | 2/1976 | Hutter | 339/218 M |

OTHER PUBLICATIONS

IBM Bulletin, Evans, vol. 9, No. 10, p. 1299, 3-1967.

*Primary Examiner*—Neil Abrams
*Attorney, Agent, or Firm*—Howard L. Rose

[57] ABSTRACT

A coaxial connector having a useful frequency range extended to 26.5 GHz is characterized by two separate dielectric support members. A first dielectric member is injection-molded into the annular space between the center conductor and the outer shell at a location rearward of the center conductor mating region. Injection molding provides positive longitudinal support for the center conductor without use of means such as epoxy or crimping which cause higher losses and introduces mismatches around the center conductor. A second dielectric member is press-fit into the shell to surround but not contact the center conductor in the mating region. The second dielectric member is contoured to support the center conductor during mating, to provide the desired characteristic impedance, and to compensate for distortion produced by the gap subsisting between the second dielectric members of a mated plug and jack.

5 Claims, 5 Drawing Figures

COAXIAL CONNECTOR

This is a continuation of application Ser. No. 95,433, filed Nov. 19, 1979, now abandoned.

TECHNICAL FIELD

The present invention relates to improvements in coaxial connectors, particularly those designated SMA-type (or APC-3MM) connectors, whereby the useful frequency range of such connectors is extended to at least 26.5 Hz.

BACKGROUND ART

Standard commercially available SMA connectors have useful frequency ranges from DC to approximately 22 GHz. The limitation is imposed by the existence of a resonance mode in the connector structure slightly above 22 GHz. This is caused by the nature and dimensions of resulting dielectric filled cavity as shown in FIG. 1, represented by the total length $1_t$ and diameter and producing a $TE_{11}$ cavity resonance. With this configuration it is not possible to avoid the resonance by alteration of the dielectric or dimensions and still be SMA compatible. (Smaller versions notably the OSSM do, in fact, work to frequencies beyond 26.5 GHz, but it is the intention to remain SMA compatible with this device).

An attempt to avoid this resonance was made using the configuration shown in FIGS. 2 and 3. In this instance, the dielectric material is completely removed from the interface region. While this does allow operation to 26.5 GHz and beyond, the unsupported center contacts, particularly the female side, are subject to a greater degree of breakage.

It is therefore an object of the present invention to provide an improved SMA-type coaxial connector which is mode-free up to at least 26.5 GHz.

It is a further object of the present invention to provide an improved SMA connector in which annular spaces between the center conductor and the dielectric support member are eliminated and wherein the gap between the dielectric supports of mated male and female connectors is minimized.

DISCLOSURE OF THE INVENTION

In accordance with the present invention, the dielectric support member is provided as two separate axially-spaced members. The rearward member is injection-molded into the annular space between the center conductor and the connector shell to preclude existance of unwanted spaces between the connector and the dielectric support. The forward member is press-fit into the shell, spaced from the center conductor, and includes a forward lip that projects radially toward the conductor to provide support therefor during connector mating while permitting expansion of the finger-like projections of the female connector. The dielectric material can be a phenylene oxide based resin, most preferably polyphenylene oxide, or any material which is injection moldable and has a similar dielectric constant and heat deflection temperature.

BRIEF DESCRIPTION OF THE DRAWINGS

The above and still further objects, features and advantages of the present invention will become apparent upon consideration of the following detailed description of one specific embodiment thereof, especially when taken in conjunction with the accompanying drawings, wherein.

BEST MODE OF CARRYING OUT THE INVENTION

Figure 1:
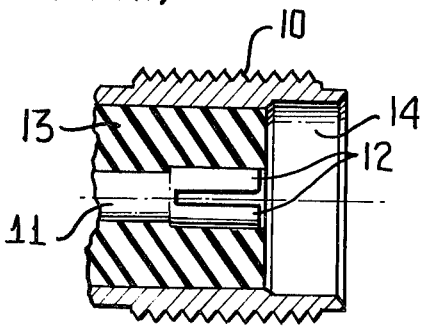
FIG. 1 (PRIOR ART)
FIG. 1 is a view in section of a typical prior art female SMA connector.
Figure 2:
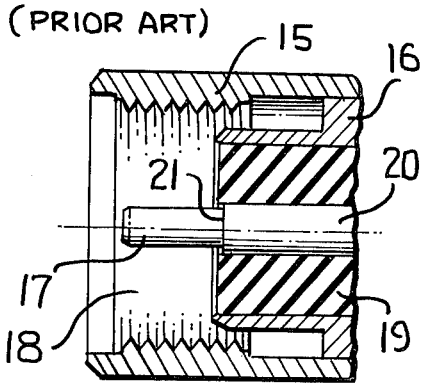
FIG. 2 (PRIOR ART)
FIG. 2 is a view in section of a typical prior art male SMA connector.
Figure 3:
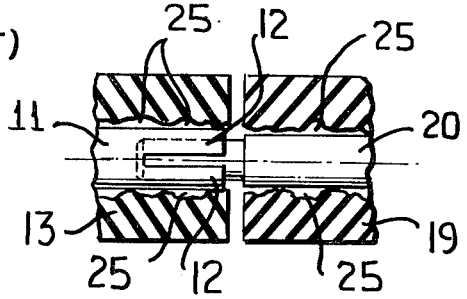
FIG. 3 (PRIOR ART)
FIG. 3 is a view in section of portions of the connector of FIGS. 1 and 2, shown in mated condition, in which certain details have been exaggerrated for purposes of illustration.

In order to properly set forth the frequency-limiting features of the prior art SMA connectors, reference is made initially to FIGS. 1, 2 and 3. The jack of FIG. 1 includes a metal outer housing or shell 10 of generally cylindrical configuration which is circumferentially threaded to be engaged by the plug of FIG. 2. A female center conductor 11 is disposed concentrically within shell 10 and includes angularly separated spring fingers 12 at its forward end. The annular space between conductor 11 and shell 10 is taken up by a dielectric support member 13 which is conventionally compression-molded into that space. Typically, dielectric support member 13 is made of Teflon or some material with similar dielectric properties. The rearward end of the jack is adapted for mechanical engagement with a coaxial cable in accordance with conventionally used cable and connectors. The forward end of the jack includes a cylindrical recess region 14 about which shell 10 extends forwardly of dielectric member 13 and center conductor 11. The forward end of center conductor 11 is either flush with the forward end of dielectric member 13 or, more typically, slightly recessed rearwardly by a distance on the order of a few thousandths of an inch.

The typical prior art SMA coaxial plug of FIG. 2 includes a metal outer body member 15 which is rotatable about the plug longitudinal axis and which is internally threaded to engage the threaded periphery of shell 10 of the jack of FIG. 1. A metal shell 16 is disposed concentrically within body member 15 and is secured thereto in a conventional manner to permit free rotation and limited axial displacement of member 15 relative to shell 16. With member 15 extended to its most forward position relative to shell 16 (as shown in FIG. 2), member 15 extends forwardly of shell 16 to define an annular space 18 about the forward end 17 of male center contact or conductor 20. Conductor 20 projects forwardly into space 18 from within shell 16 within which the conductor is concentrically disposed. Dielectric support member 19 is compression-molded into the annular space between conductor 20 and shell 16. The forward end of dielectric member 19 is either flush with the forward end of shell 16 or, more typically is recessed slightly rearwardly by a distance on the order of a few thousandths of an inch. The forward end 17 of center conductor 20 is smaller in diameter than the section supported in dielectric member 19, the junction between the two sections being articulated by an annular shoulder 21. Shoulder 21 is either flush with the forward end of dielectric member 19 or, more typically, is recessed rearwardly by a distance on the order of a few thousandths of an inch.

As best seen in the exaggerated illustration of FIG. 3, the machined and pressed in place or otherwise retained dielectric members 13 and 19 fit improperly about conductors 11 and 20, respectively, resulting in multiple irregularly shaped spaces 25 existing between the conductors and the dielectric members. In fact, these spaces 25 serve to permit expansion of fingers 12 when the forward end of conductor 20 is inserted therein. However, the spaces or discontinuities raise the impedance of the connector to a degree dependent upon their sizes. The result is an increase in VSWR due to the non-50 ohm nature of that region where air spaces are present. In addition, when the plug and jack are mated with the forward end 17 of conductor 20 inserted into conductor 11 as far as possible, there is a discontinuity gap between dielectric members 13 and 19 of the respective connectors. This gap presents a highly inductive series impedance to the transmission path, with the result that the VSWR introduced by the connector increases significantly with frequency and thereby limits operation at high frequencies.

Figure 4:
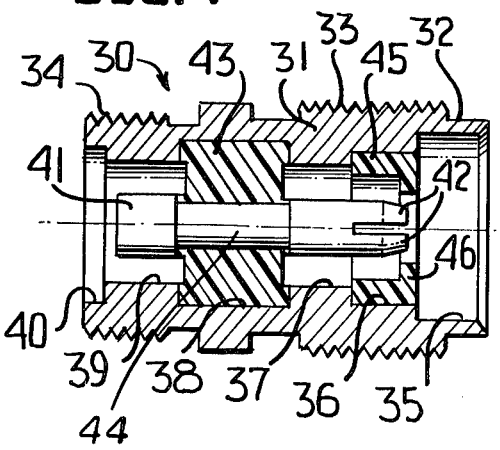
FIG. 4 is a view in section of a female connector in accordance with the principles of the present invention.
Figure 5:
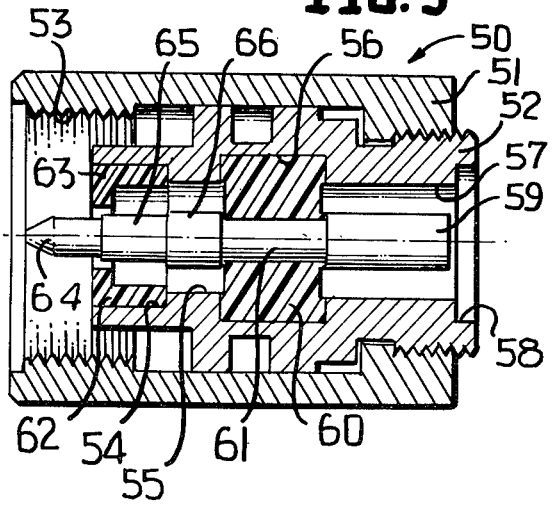
FIG. 5 is a view in section of a male connector constructed in accordance with the principles of the present invention.

The connectors illustrated in FIGS. 4 and 5 permit the operating frequency range of SMA connectors to be expanded up to 26.5 GHz, while maintaining the jack and plug compatible with prior art SMA plugs and jacks, respectively. Specifically, and referring to FIG. 4, jack receptacle 30 includes a hollow, generally cylindrical metal outer shell 31. The periphery of shell 31 includes a short forward section 32 of relatively small diameter followed by a threaded section 33 of somewhat larger diameter which is adapted to be engaged by an outer body member of a plug. In addition, the rearward end 34 of shell 31 is threaded to be engaged by a cable assembly termination member. The interior of shell 31 includes a series of sections of different diameter. A forward section 35 extends beyond outer forward section 32 to within a portion of threaded section 33 and has a diameter which permits it to smoothly receive the forward end of the shell of a plug. Proceeding in a rearward direction, section 35 is followed by a second section 36 of smaller diameter, a third section 37 of still smaller diameter, a fourth section 38 of diameter larger than section 37, a fifth section 39 of smaller diameter than section 38, and a rear section 40 of larger diameter than section 39. A center conductor or contact 41 includes annularly spaced spring fingers 42 at its forward end which typically terminates a few thousandths of an inch (e.g. 0.003 inch) rearward of the transition between sections 35 and 36. Conductor 41 is coaxially centered within shell 31 and is held in place by a dielectric support member 43. As an important feature of this invention, dielectric support member is injection-molded about the center conductor 41 and fills section 38 of the shell. The injection molding of member 43 may be accomplished by any well known injection molding technique wherein specifically-devised tools hold shell 31 and conductor 41 in proper orientation within a die that permits the dielectric material to be injected into and fill section 38 about the conductor. It is noted that shell sections 37 and 39 are of smaller diameter than filled section 38 and thereby preclude axial movement of dielectric member 43. In addition, the portion 44 of conductor 41 which is surrounded by dielectric member 43 is of reduced diameter as compared to the rest of the conductor to thereby preclude axial movement of the conductor within the dielectric member. In order to preclude rotational movement of dielectric member 43 within shell 31, the wall of section 38 is threaded or serrated. Likewise, to preclude mutual rotation between conductor 41 and dielectric member 43, portion 44 of the conductor may be threaded or serrated.

By injection-molding dielectric member 43, gaps or spaces between the conductor and dielectric are eliminated, thereby maintaining a low VSWR. The particular plastic employed for dielectric member 43 must, of course, be injection-moldable. In addition, its dielectric constant must be less than 3.2 and its heat deflection temperature must be relatively high. In general, phenylene oxide based resins meet these requirements and a preferred resin for this application is polyphenylene oxide (PPO), which may be obtained from the General Electric Company and which has a dielectric of approximately 2.55 and a heat deflection temperature of 345° F. It is also possible to use polycarbonate which has a dielectric constant of 3.02 and a heat deflection temperature of 265° C.

The rearward end of conductor 41 is adapted to be mechanically connected to the center conductor of a coaxial cable and extends rearwardly of dielectric member 43 without extending beyond shell section 39.

A further dielectric member 45 is press-fit into section 36 of shell 31. Member 45 is of generally annular configuration with an outer diameter similar to the diameter of section 36 to permit firm press-fit engagement. The inner diameter of member 45 throughout rearward and major portion of its axial length is substantially larger than the diameter of center conductor 41 in that region so that there is considerable radial space between conductor and member 45 in that region. The forward end of member 45 has a lip 46 of much smaller inner diameter, typically only a few thousandths of an inch (e.g. 0.003 inch) larger than the outer diameter of the forward end of the conductor 41. Member 45 is axially co-extensive with section 36 so that the forward end of lip 46 extends a few thousandths of an inch forward of fingers 42 of conductor 41. Lip 46 thus serves to provide physical support for conductor 41 which may bend and possibly break during mating with a plug, particularly if care is not taken to properly align these two conductors.

The region of member 45 rearward of lip 46 is contoured to provide the desired characteristic impedance (e.g. 50 ohms for SMA connectors). This contouring takes into account the nature of the material being employed and the cross-sectional area of the rearward section of the member, a technique which is conventional in the design of coaxial connectors and particularly the shape of dielectric members employed in such connectors. In addition, member 45 extends rearwardly a distance which is co-extensive with the slots between fingers 42 of center conductor 41. I have found that this dimensioning of the member 45 serves to compensate for any distortion introduced into the connector impedance by the aforesaid slots. The configuration of the lip 46 is chosen to compensate for the gap which exists between lip 46 and the dielectric member of a mating plug. Specifically, as mentioned above, such a gap between the dielectric members of mating connectors introduces a series inductance into the connector impedance. The annular lip 46 introduces capacitive effects which, if properly contoured, compensate for the inductive gap. The precise dimensions of member 45, of course, depend upon overall dimensions of the particular connector and can be readily computed in the manner conventionally employed for designing dielectric inserts in such connectors.

The mating plug connector 50 of the present invention is illustrated in FIG. 5. A hollow outer metal body member 51 is retained in a conventional manner about the periphery of a shell 52 such that the body member 51 is rotatable about the central longitudinal axis of the shell. Body member 51 is internally threaded at 53 proximate its forward end to permit threaded engagement with section 33 of the jack of FIG. 4. The interior of shell 52 is subdivided into multiple sections of different diameter. The forward section 54 has substantially the same diameter as section 36 in shell 31 of the jack of FIG. 4. The next rearward section 55 is of smaller diameter and is followed by a third section 56 of larger diameter and a fourth section 57 of substantially the same diameter as section 55. The most rearward section 58 is of larger diameter than section 57. A male center contactor or conductor 59, adapted to be inserted between and be engaged by fingers 42 of conductor 41, is held in place along the longitudinal center line of shell 52 by a dielectric support member 60. Support member 60 is injection-molded into section 56 so as to fill the space about the conductor in that region without leaving air gaps between the support member and the conductor. The larger diameter of section 56, as compared to adjacent sections 55 and 57, precludes axial movement of the support member within the shell 52. The wall of section 56 may be threaded or serrated to preclude rotational movement of the dielectric support member in the shell. The conductor 59 has a section 61 of reduced cross-section within section 56 of the shell to prevent axial movement of the conductor in the support member 60. Likewise, sections 61 of the conductor may be threaded or serrated to avoid relative rotational movement between the support member and conductor. Support member 60 is made from the same material as member 43 of FIG. 4.

A further dielectric member 62, identical to member 45 of FIG. 4, is press-fit into forward section 54 of shell 52. Whereas the main portion of the body of member 62 is spaced a considerable radial distance from conductor 59, annular lip 63 of that member is but a few thousandths of an inch away from the conductor to provide lateral support during connector mating. The forward end 64 of conductor 59 projects forwardly a considerable distance beyond shell 52 and member 62 so as to permit the conductor to extend into the space between fingers 42 of jack 30 when connectors 30 and 50 are mated. In addition, the center conductor 59 includes sections 65 and 66, successively rearward of forward end 64, these sections having successively larger diameters. The transition between section 65 and forward end 64 is an annular shoulder disposed within the lip 63 of member 62. This stepping down of the diameter of male center conductor 59 toward the forward end 64 serves to maintain symmetry in the connector pair.

The features and advantages of member 62 and its annular lip 63 are the same as those described with respect to member 45 and lip 46, the two members serving together to compensate jointly for impedance variations introduced by the gap subsisting between them when the two connectors are mated.

In summary, the female and male connectors described in rotation to FIGS. 4 and 5 avoid annular gaps between the center conductors and the dielectric support members by injection-molding, rather than compression molding, the support members about the conductors. In addition, the forward dielectric members 45 and 62 provide lateral support for the forward ends of the conductors and compensate for impedance distortions introduced by virtue of the spacing between these members when the connectors are mated and by the slots between fingers 42 in the female conductor.

While I have described and illustrated one specific embodiment of my invention, it will be clear that variations of the details of construction which are specifically illustrated and described may be resorted to without departing from the true spirit and scope of the invention as defined in the appended claims.

I claim:

1. A coaxial connector having mating connector members and comprising:

a first and second coneuctive shells having forward and rearward ends;

each said shells having center conductor means having forward and rearward ends adjacent said forward and rearward ends of said hollow conductive shells;

said center conductor means mating forward ends;

each said shells having first dlectric support means injection-molded into said shell at a location intermediate said forward and rearward ends for supporting said center conductor means generally concentrically within said shell; and each said shells having second dielectric means press-fitted into said shell proximate said forward end thereof and surrounding and radially-spaced from said center conductor by a distance to impart a desired characteristic impedance to said conductor;

each said second dielectric means including lip means extending radially toward and spaced from said center conductor means adjacent its forward end for limiting flexure of said center conductor means;

each said lip means spaced rearwardly from said forward end of its associated conductive shell to provide compensating means for cooperating with said lip means associated with the other of said compensating means to compensate for impedance distortions introduced by the space between said second dielectric means, when said coaxial connectors are mated, and wherein said first and second dielectric means are axially spaced from one another, and one of said coaxial connectors is a jack wherein said center conductor means has said forward-end formed as a plurality of angularly spaced fingers having slots therebetween and disposed about a common axis, and wherein said second dielectric means has an annular portion having opposed end surfaces and a lip extending from its inner surface, the full longitudinal dimension of said annular portion between said end surfaces being axially substantially of the same length as and radially aligned with said slots and configured such that the complete axial extent of said lip is spaced from said center conductor which it surrounds to compensate for connector impedance distortion introduced by said slots.

2. A coaxial connector according to claim 1 wherein said first dielectric support means and said second dielectric means are made from material having a dielectric constant of less than 3.2 and a heat deflection temperature in excess of 250° F.

3. A coaxial connector according to claim 1 wherein said first connector shell has an inner wall which is subdivided into successive axial sections of different diameter, said first dielectric support means being injection molded into one such section having a diameter which is larger than the diameter of the two immediately adjacent sections; and wherein said center conductor means includes one portion of narrower diameter than adjacent portions thereof coextensive with said one such section and about which said first dielectric support means is injection molded.

4. A coaxial connector according to claim 3 wherein the surfaces of said one such section and said one portion include means for preventing rotational movement of said first dielectric support means relative to said shell and said center conductor means, respectively.

5. A coaxial connector according to claim 1 wherein said second dielectric means includes a rearward part annularly surrounding and considerably spaced from said center conductor means; and wherein said lip means is forward of said rearward part and extends radially inward from said rearward part to annularly surround said center conductor means at a spacing of approximately a few thousandths of an inch therefrom.

* * * * *